US011255639B2

(12) United States Patent
Maynard

(10) Patent No.: US 11,255,639 B2
(45) Date of Patent: Feb. 22, 2022

(54) RETICLE ALIGNMENT TOOL

(71) Applicant: Marc L. Maynard, Spencerport, NY (US)

(72) Inventor: Marc L. Maynard, Spencerport, NY (US)

( * ) Notice: Subject to any disclaimer, the term of this patent is extended or adjusted under 35 U.S.C. 154(b) by 499 days.

(21) Appl. No.: 16/285,547

(22) Filed: Feb. 26, 2019

(65) Prior Publication Data

US 2020/0271417 A1 Aug. 27, 2020

(51) Int. Cl.
*F41G 1/54* (2006.01)
*B25D 1/16* (2006.01)

(52) U.S. Cl.
CPC ..... *F41G 1/545* (2013.01); *B25D 1/16* (2013.01)

(58) Field of Classification Search
CPC ..... F41G 1/545; B25D 1/16
USPC ..... 33/298
See application file for complete search history.

(56) References Cited

U.S. PATENT DOCUMENTS

D345,514 S 3/1994 Donnelly
D348,503 S 7/1994 Claveau
D392,855 S 3/1998 Pillow
5,878,504 A * 3/1999 Harms ..... F41G 1/545 42/120
D416,771 S 11/1999 Cagle
6,298,568 B1 10/2001 Johnson et al.
6,553,679 B2 4/2003 Todd
D595,599 S 7/2009 McHowell
8,028,434 B2 10/2011 McHowell
D657,274 S 4/2012 Neethling
D684,830 S 6/2013 Glynn et al.
D686,686 S 7/2013 Dueck
D686,687 S 7/2013 Dueck
9,115,957 B1 * 8/2015 Winker ..... F41G 3/323
D741,731 S 10/2015 Lamanna et al.
9,377,273 B1 * 6/2016 Loper ..... F41G 1/545
D779,979 S 2/2017 Eisinger
D847,672 S 5/2019 Kennedy
2018/0328696 A1 * 11/2018 Senn ..... F41G 1/545
2020/0271417 A1 * 8/2020 Maynard ..... B25D 1/16

* cited by examiner

*Primary Examiner* — Samir Abdosh
(74) *Attorney, Agent, or Firm* — Michael J. Nickerson; Basch & Nickerson LLP

(57) ABSTRACT

A L-shaped reticle alignment tool includes a vertical adjustment leg; a horizontal adjustment leg; and a sliding hammer. The L-shaped reticle alignment tool includes a vertical adjustment recess located on the vertical adjustment leg. The L-shaped reticle alignment tool includes a horizontal adjustment recess located on the horizontal adjustment leg. The sliding hammer moves in a direction parallel to the horizontal adjustment leg.

10 Claims, 8 Drawing Sheets

RETICLE ALIGNMENT TOOL

BACKGROUND

A conventional target acquisition system can provide long-range sensor and anti-armor/precision assault fire capabilities, enabling a user to shape the battlefield by detecting and engaging targets at a long range for destruction by a weapon system. The target acquisition system provides reconnaissance, surveillance, and target acquisition.

The target acquisition system includes an integrated far-target location capability via a position attitude determination subsystem, a fire-control subsystem, a lithium-ion battery power source, and a modified traversing unit to enable detection and engagement of long-range targets.

A target acquisition system can reduce operator workload by optimizing the image presented to the gunner through electronic processing. Electronic focus, image stabilization, and other processing techniques ensure that the presented image is optimized for the environment without manual manipulation of the various adjustment settings.

Due to the conditions of the environment in which a target acquisition system may be employed, the reticle within the sight system may become unaligned, thereby providing inaccurate target information for the weapon system. Thus, from time to time, the reticle within the sight system of the target acquisition system must be re-aligned (re-calibrated) to insure accurate target information.

FIG. 1 illustrates a block diagram of a sighting system 10 of the target acquisition system. As illustrated in FIG. 1, the sighting system 10 includes a reticle 20, a first component 40, a second component 50, and a third component 60.

In the sighting system 10 of the target acquisition system, the first component 40, second component 50, and third component 60 define a sight area (volume) 30. The sight area (volume) 30 is the space that provides access to the reticle 20 to perform alignment procedures.

The sight area (volume) 30 of the sighting system 10 of the target acquisition system is a very tight space, making an alignment procedure a difficult task to perform.

Conventionally, to align the reticle 20, an operator is instructed to loosen the mounting screws holding the reticle 20 in place. Upon loosening the mounting screws, the operator aligns the reticle 20 by striking or tapping the reticle 20 with a tool having sufficient mass, such as a wrench, while observing reading being actively displayed.

Although the conventional procedure provides a means to align the reticle, the procedure requires that the "tapping" tool must be moved from front to back for horizontal adjustment of the reticle and top to bottom for vertical adjustment of the reticle. This re-positioning of the "tapping" tool is problematic because there is very little clearance above the reticle assembly so downward striking is difficult.

Also, the "tapping" tool may not be coated. Therefore, if the uncoated "tapping" tool is dropped, the uncoated "tapping" tool could potentially short the electronics located directly below to reticle.

Moreover, the "tapping" tool may accidently strike non-reticle components surrounding the sight area and damage such components.

Therefore, it is desirable to provide an alignment tool that can align the reticle without having to move the alignment tool, front to back or back to front, for horizontal adjustment.

In addition, it is desirable to provide an alignment tool that can align the reticle without having to move the alignment tool, top to bottom or bottom to top, for vertical adjustment.

Moreover, it is desirable to provide an alignment tool that can align the reticle without having to move the alignment tool, front to back or back to front, for horizontal adjustment and having to move the alignment tool, top to bottom or bottom to top, for vertical adjustment.

Furthermore, it is desirable to provide an alignment tool that can effectively align the reticle within the tight clearance environment of the sighting system.

Also, it is desirable to provide an alignment tool that can effectively align the reticle while substantially eliminating the risk for damage to surrounding components.

BRIEF DESCRIPTION OF THE DRAWINGS

The drawings are only for purposes of illustrating various embodiments and are not to be construed as limiting, wherein.

DETAILED DESCRIPTION

Figure 1:
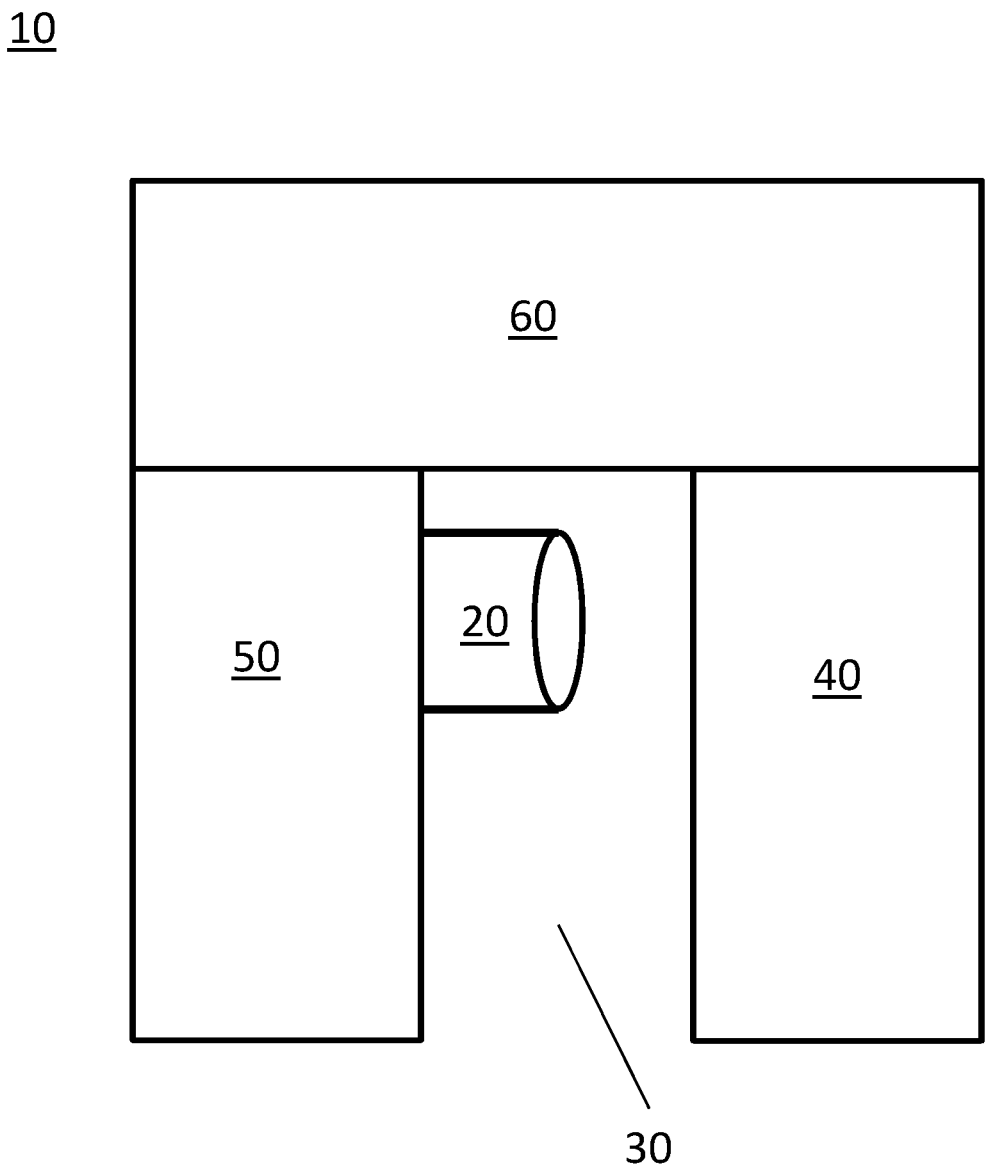
FIG. 1 shows a block diagram of a sighting system of a conventional target acquisition system.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Figure 2:
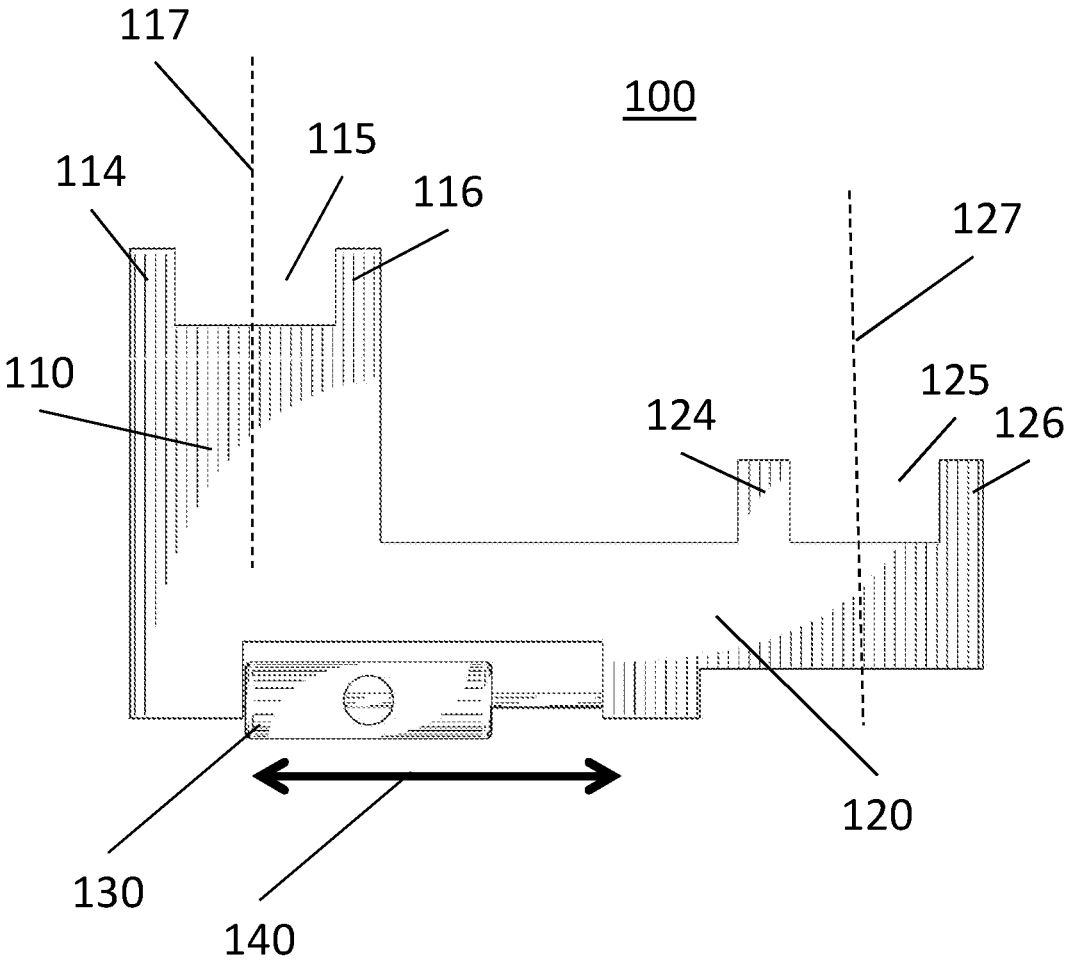
FIG. 2 illustrates an example of a reticle alignment tool.

As illustrated in FIG. 2, a reticle alignment tool 100 is a L-shaped tool having a vertical adjustment leg 110 and a horizontal adjustment leg 120. The reticle alignment tool 100 includes a sliding hammer 130 for providing the force to adjust or re-align a reticle. The sliding hammer 130 can move in two directions as shown by doubled arrow line 140.

The vertical adjustment leg 110 includes two projections, 114 and 116, which form a vertical adjustment well (recess) 115. The vertical adjustment well (recess) 115 is shaped to engage the reticle when the reticle is being aligned in a vertical direction.

Figure 3:
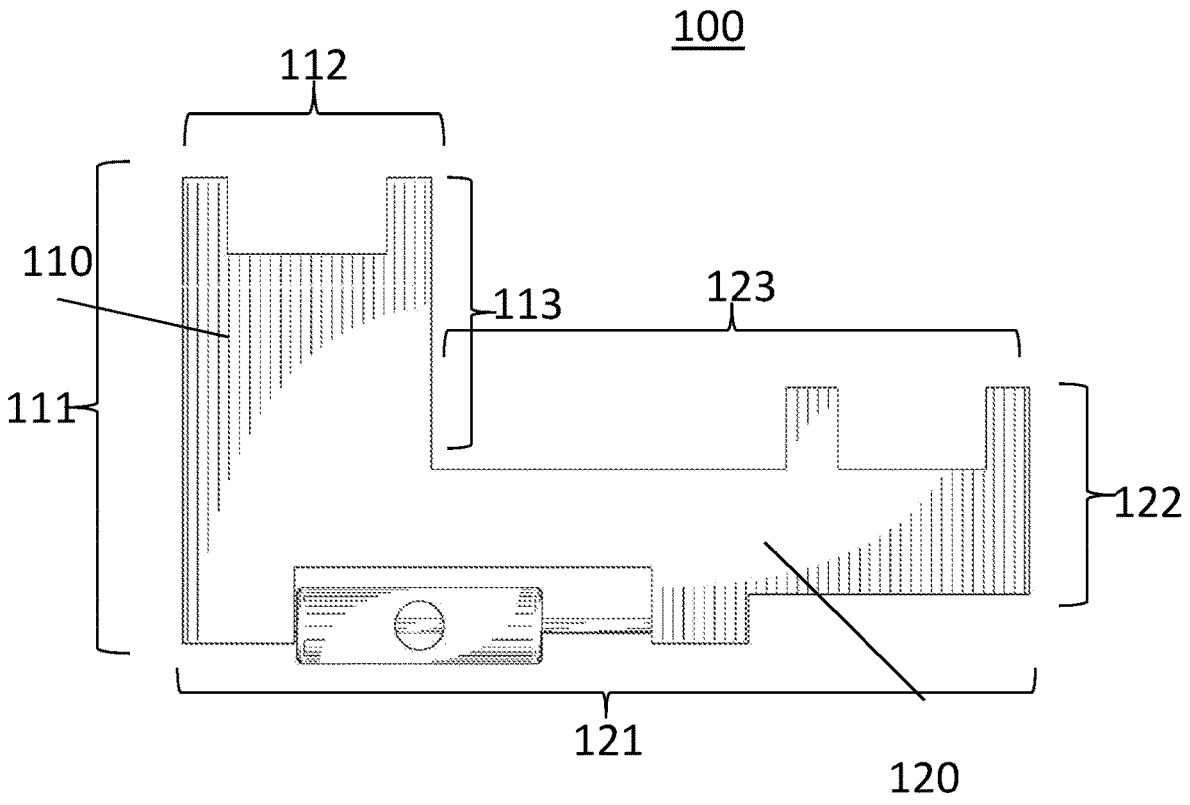
FIG. 3 shows features of the reticle alignment tool.

It is noted that the vertical adjustment well (recess) 115 is located on a vertical width side 112 (FIG. 3).

The horizontal adjustment leg 120 includes two projections, 124 and 126, which form a horizontal adjustment well (recess) 125. The horizontal adjustment well (recess) 125 is shaped to engage the reticle when the reticle is being aligned in a horizontal direction.

It is noted that the horizontal adjustment well (recess) 125 is located on a second horizontal length side 123 (FIG. 3).

It is noted that depending upon the angle of the reticle alignment tool 100, with respect to the reticle, the reticle alignment tool 100 can provide simultaneous horizontal and vertical adjustment through engagement of the reticle with either the vertical adjustment well (recess) 115 or the horizontal adjustment well (recess) 125.

As illustrated in FIG. 2, the horizontal adjustment well (recess) 125 has a center horizontal adjustment well line 127 and the vertical adjustment well (recess) 115 has a center horizontal adjustment well line 117. The center horizontal adjustment well line 127 is substantially parallel to the center vertical adjustment well line 117.

U.S. Design patent application Ser. No. 29/680,784, filed on Feb. 20, 2019, provides perspective views of the reticle alignment tool. The entire content of U.S. Design patent application Ser. No. 29/680,784, filed on Feb. 20, 2019, is hereby incorporated by reference.

FIG. 3 provides a view of the reticle alignment tool to assist in understanding the configuration thereof. As illustrated in FIG. 3, the reticle alignment tool 100 is a L-shaped tool having a vertical adjustment leg 110 and a horizontal adjustment leg 120. The vertical adjustment leg 110 includes a first vertical length side 111, a second vertical length side 113, and a vertical width side 112. The horizontal adjustment leg 120 includes a first horizontal length side 121, a second horizontal length side 123, and a horizontal width side 122.

It is noted that the horizontal width side 122 is substantially parallel to the first vertical length side 111 and the second vertical length side 113 and is substantially orthogonal to the first horizontal length side 121, the second horizontal length side 123, and the vertical width side 112.

It is also noted that the vertical width side 112 is substantially parallel to the first horizontal length side 121 and the second horizontal length side 123 and is substantially orthogonal to the first vertical length side 111, the second vertical length side 113, and the horizontal width side 122.

The sliding hammer 130 moves in parallel to the first horizontal length side 121 and the second horizontal length side 123.

Figure 4:
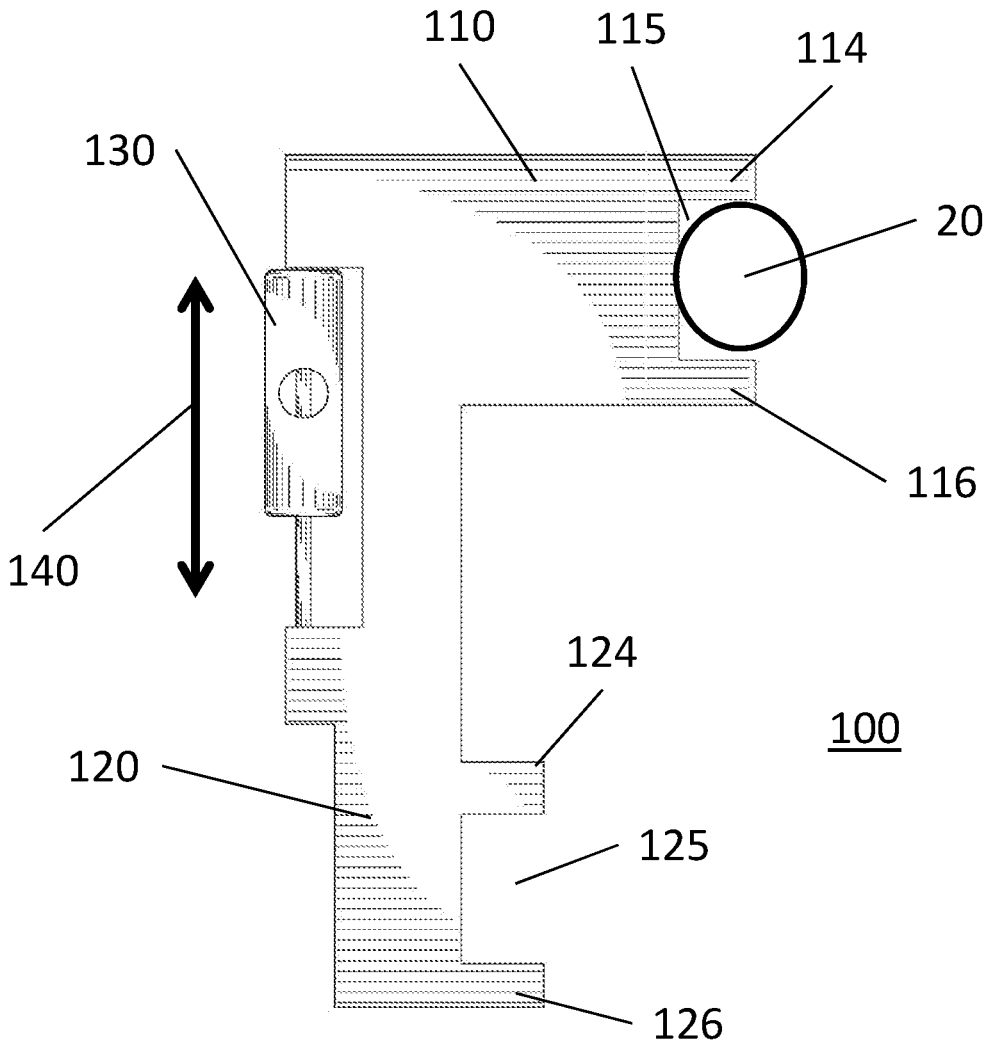
FIG. 4 shows the reticle alignment tool providing vertical adjustment of the reticle.

FIG. 4 shows a reticle alignment tool 100 providing vertical adjustment of the reticle. As illustrated in FIG. 4, a reticle alignment tool 100 engages a reticle 20 for vertical adjustment (alignment). More specifically, the vertical adjustment well (recess) 115 receives and engages the reticle 20 to provide physical contact thereto.

As the sliding hammer 130 is moved upwardly to strike the reticle alignment tool 100, the upward force is transferred to the reticle 20 through the projection 116. On the other hand, as the sliding hammer 130 is moved downwardly to strike the reticle alignment tool 100, the downward force is transferred to the reticle 20 through the projection 114.

In this configuration, the reticle 20 can be adjusted in a vertical manner (up or down) without having the reticle alignment tool 100 re-positioned with respect to the reticle 20. The reticle alignment tool 100 maintains its position and the striking direction of the sliding hammer 130 dictates the vertical direction of the adjustment of the reticle 20.

Figure 5:
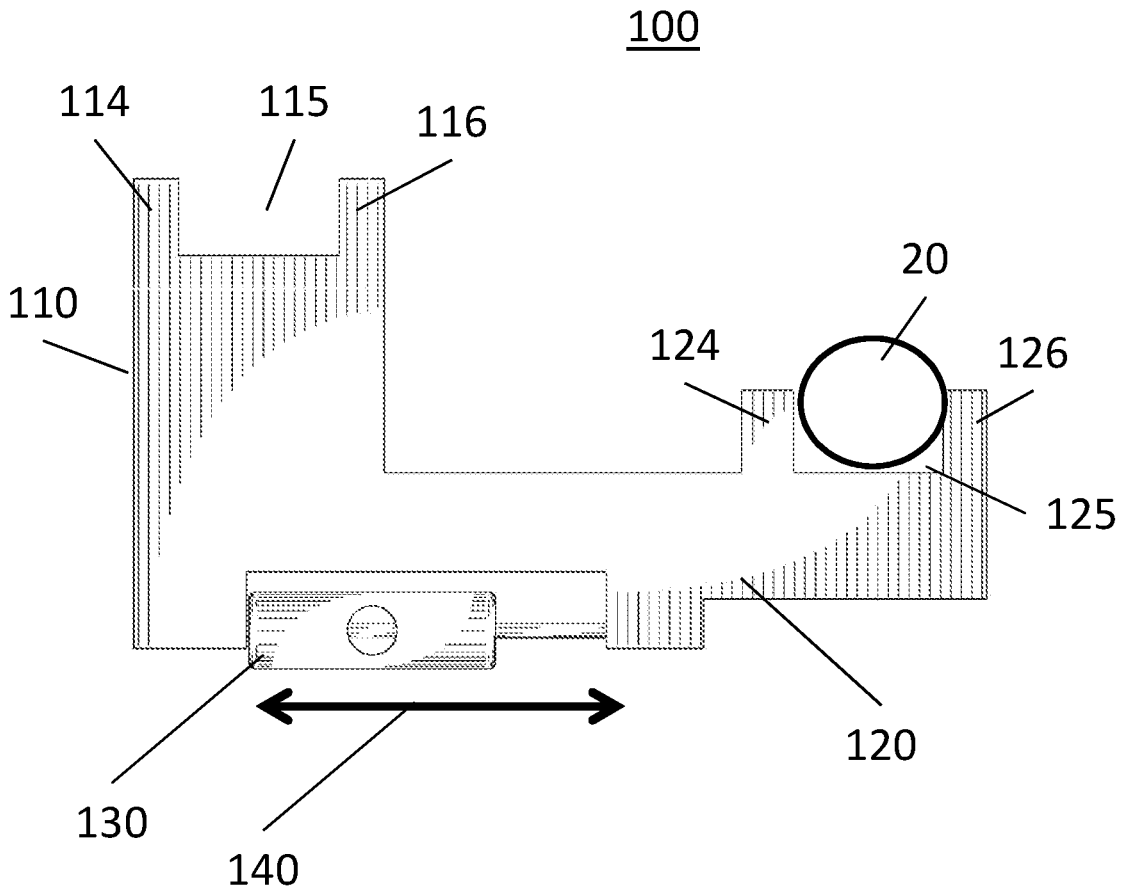
FIG. 5 shows the reticle alignment tool providing horizontal adjustment of the reticle.

FIG. 5 shows a reticle alignment tool 100 providing horizontal adjustment of the reticle. As illustrated in FIG. 5, a reticle alignment tool 100 engages a reticle 20 for horizontal adjustment (alignment). More specifically, the horizontal adjustment well (recess) 125 receives and engages the reticle 20 to provide physical contact thereto.

As the sliding hammer 130 is moved inwardly to strike the reticle alignment tool 100, the inward force is transferred to the reticle 20 through the projection 124. On the other hand, as the sliding hammer 130 is moved outwardly to strike the reticle alignment tool 100, the outward force is transferred to the reticle 20 through the projection 126.

In this configuration, the reticle 20 can be adjusted in a horizontal manner (inward or outward) without having the reticle alignment tool 100 re-positioned with respect to the reticle 20. The reticle alignment tool 100 maintains its position and the striking direction of the sliding hammer 130 dictates the horizontal direction of the adjustment of the reticle 20.

Figure 6:
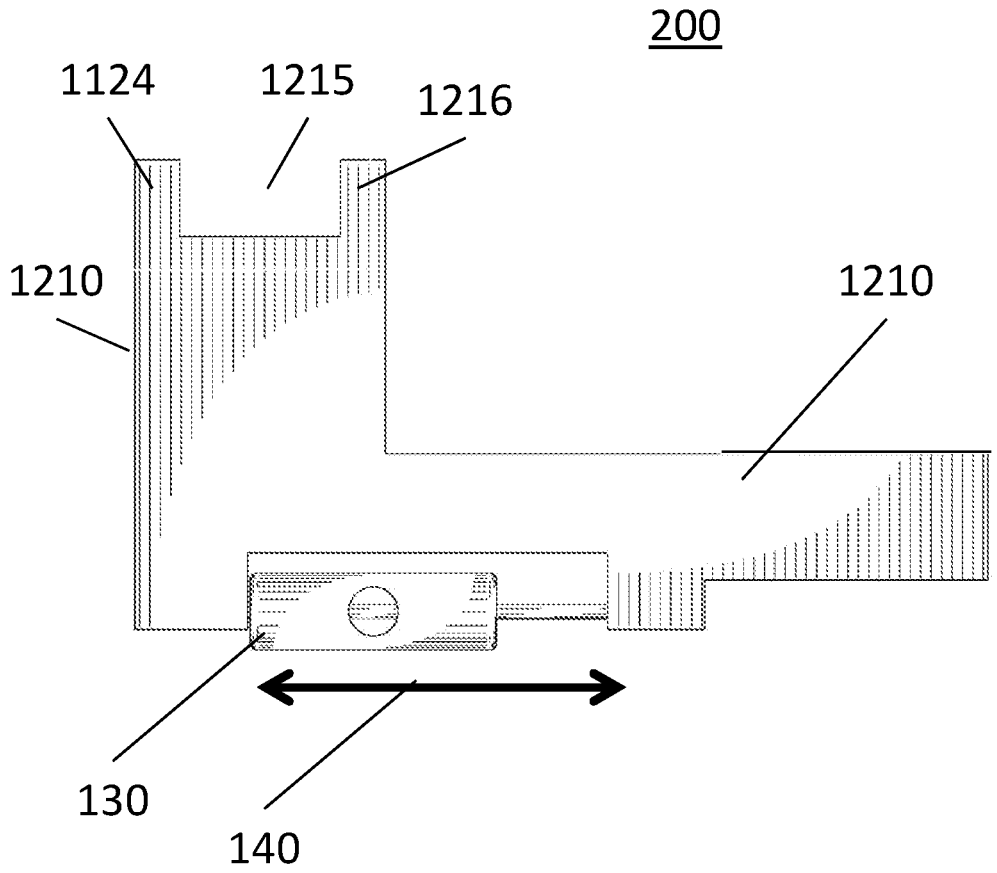
FIG. 6 shows an example of a vertical adjustment reticle alignment tool.

FIG. 6 shows an example of a vertical adjustment reticle alignment tool. As illustrated in FIG. 6, a vertical adjustment reticle alignment tool 200 is a L-shaped tool having a vertical adjustment leg 1110 and a handle leg 1210. The reticle alignment tool 200 includes a sliding hammer 130 for providing the force to adjust or re-align a reticle in a vertical direction. The sliding hammer 130 can move in two directions as shown by doubled arrow line 140.

The vertical adjustment leg 1110 includes two projections, 1114 and 1116, which form a vertical adjustment well (recess) 1125. The vertical adjustment well (recess) 1115 is shaped to engage the reticle when the reticle is being aligned in a vertical direction.

It is noted that depending upon the angle of the reticle alignment tool 200, with respect to the reticle, the reticle alignment tool 200 can provide simultaneous horizontal and vertical adjustment through engagement of the reticle with the vertical adjustment well (recess) 1115.

It is noted that the vertical adjustment reticle alignment tool 200 does not include a horizontal adjustment well (recess).

Figure 7:
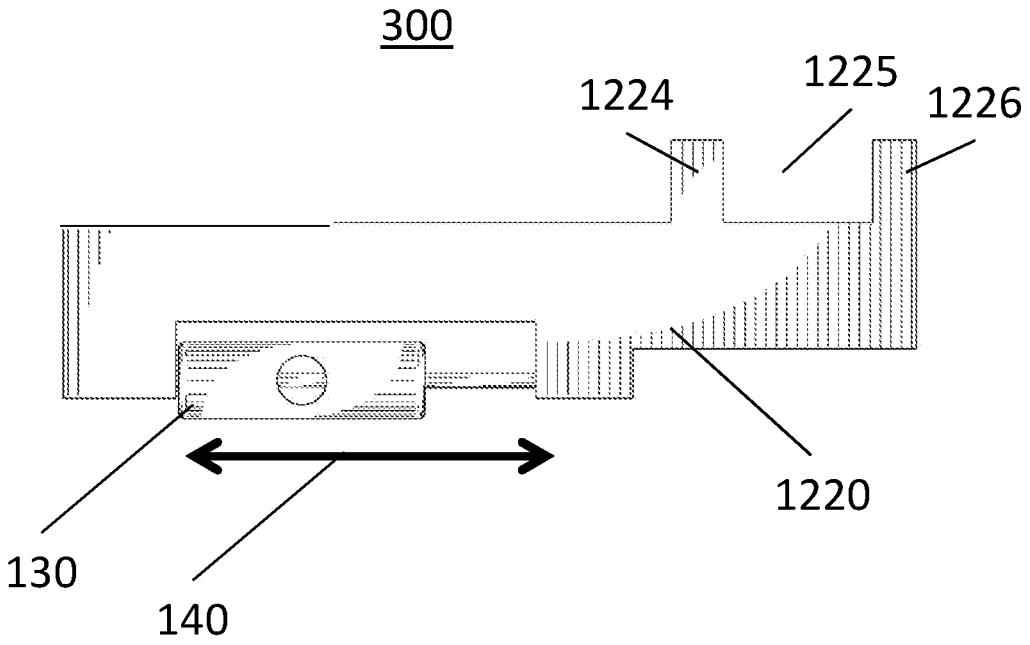
FIG. 7 shows an example of a horizontal adjustment reticle alignment tool.

FIG. 7 shows an example of a horizontal adjustment reticle alignment tool. As illustrated in FIG. 7, a horizontal adjustment reticle alignment tool 300 has a horizontal adjustment member 1220. The reticle alignment tool 300 includes a sliding hammer 130 for providing the force to adjust or re-align a reticle in a horizontal direction. The sliding hammer 130 can move in two directions as shown by doubled arrow line 140.

The horizontal adjustment member 1220 includes two projections, 1224 and 1226, which form a horizontal adjustment well (recess) 1225. The horizontal adjustment well (recess) 1225 is shaped to engage the reticle when the reticle is being aligned in a horizontal direction.

It is noted that depending upon the angle of the reticle alignment tool 300, with respect to the reticle, the reticle alignment tool 300 can provide simultaneous horizontal and vertical adjustment through engagement of the reticle with the horizontal adjustment well (recess) 1225.

It is noted that the vertical adjustment reticle alignment tool 200 does not include a horizontal adjustment well (recess).

Figure 8:
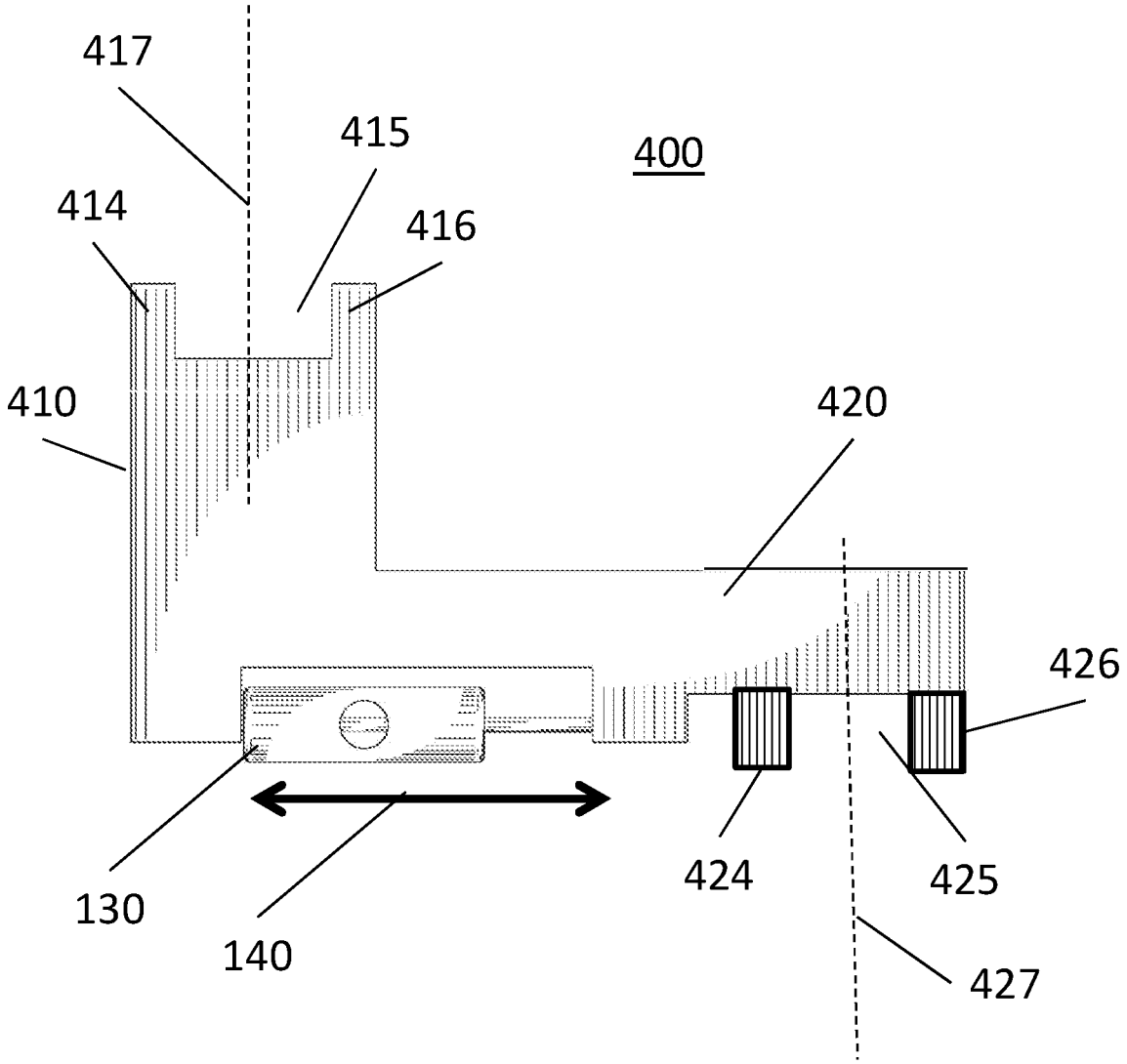
FIG. 8 shows another example of a reticle alignment tool.

FIG. 8 shows another example of a reticle alignment tool. As illustrated in FIG. 8, a reticle alignment tool 400 is a L-shaped tool having a vertical adjustment leg 410 and a horizontal adjustment leg 420. The reticle alignment tool 400 includes a sliding hammer 130 for providing the force to adjust or re-align a reticle. The sliding hammer 130 can move in two directions as shown by doubled arrow line 140.

The vertical adjustment leg 410 includes two projections, 414 and 416, which form a vertical adjustment well (recess) 415. The vertical adjustment well (recess) 415 is shaped to engage the reticle when the reticle is being aligned in a vertical direction.

It is noted that the vertical adjustment well (recess) 415 is located on a vertical width side 112 (FIG. 3).

The horizontal adjustment leg 420 includes two projections, 424 and 426, which form a horizontal adjustment well (recess) 425. The horizontal adjustment well (recess) 425 is shaped to engage the reticle when the reticle is being aligned in a horizontal direction.

It is noted that the horizontal adjustment well (recess) 425 is located on a first horizontal length side 121 (FIG. 3).

It is noted that depending upon the angle of the reticle alignment tool 400, with respect to the reticle, the reticle alignment tool 400 can provide simultaneous horizontal and vertical adjustment through engagement of the reticle with either the vertical adjustment well (recess) 415 or the horizontal adjustment well (recess) 425.

As illustrated in FIG. 8, the horizontal adjustment well (recess) 425 has a center horizontal adjustment well line 427 and the vertical adjustment well (recess) 415 has a center horizontal adjustment well line 417. The center horizontal adjustment well line 427 is substantially parallel to the center vertical adjustment well line 417.

In the various embodiments described above, the reticle alignment tool may be coated with a material having electrical insulation properties to prevent shorting if the reticle alignment tool comes in contact with other electronic components.

The reticle alignment tool may be constructed of aluminum.

The sliding hammer may be constructed of brass.

As described above, the reticle alignment tool engages the reticle assembly providing bi-directional alignment along either a horizontal or vertical plane. By sliding the hammer along the shaft of the reticle alignment tool, a technician can apply sufficient force to the reticle without damaging the reticle and avoiding potential damage to components surrounding the reticle.

The above described reticle alignment tools reduce the time to perform the alignment task since the above described reticle alignment tools stay in place and provides a more repeatable adjustment force application during use.

Some of the above described reticle alignment tools only have to be moved when switching from vertical to horizontal plane adjustment, while other above described reticle alignment tools have to be changed out when switching from vertical to horizontal plane adjustment. This makes the transition from vertical to horizontal plane adjustment or the transition from horizontal to vertical plane adjustment much easier.

In some of the above described embodiment, the reticle alignment tool can work in both planes depending on the way the reticle alignment tool is inserted into the sight.

The above described reticle alignment tools maintain constant contact with the reticle to be adjusted.

It is noted that although the various above described reticle alignment tools disclose a sliding hammer to provide the force to move the reticle to a desire position, the sliding hammer may be any integral "tapping" mechanism that enables a technician or user to apply a controlled force to the reticle alignment tool in a direction parallel to the direction that the technician or user wants the reticle to move.

In summary, a L-shaped reticle alignment tool includes a vertical adjustment leg; a horizontal adjustment leg; and a sliding hammer.

The L-shaped reticle alignment tool may include a vertical adjustment recess located on the vertical adjustment leg.

The L-shaped reticle alignment tool may include a horizontal adjustment recess located on the horizontal adjustment leg.

The vertical adjustment recess may have a center vertical adjustment recess line and the horizontal adjustment recess may have a center horizontal adjustment recess line, the center vertical adjustment recess line being parallel to the center horizontal adjustment recess line.

The sliding hammer may move in a direction parallel to the horizontal adjustment leg.

The sliding hammer may be located on a first length horizontal side of the horizontal adjustment leg and the horizontal adjustment recess may be located on a second length horizontal side of the horizontal adjustment leg, the first length horizontal side being different from the second length horizontal side.

The sliding hammer may be located on a first length horizontal side of the horizontal adjustment leg and the horizontal adjustment recess may be located on the first length horizontal side of the horizontal adjustment leg.

A L-shaped vertical reticle alignment tool includes a vertical adjustment leg; a handle leg; and a sliding hammer.

The L-shaped reticle alignment tool may include a vertical adjustment recess located on the vertical adjustment leg.

The sliding hammer may move in a direction parallel to the handle leg.

A reticle alignment tool includes a horizontal adjustment member and a sliding hammer.

The reticle alignment tool may include a horizontal adjustment recess located on the horizontal adjustment member.

The sliding hammer may be located on a first length horizontal side of the horizontal adjustment member and the horizontal adjustment recess may be located on the first length horizontal side of the horizontal adjustment member.

The sliding hammer may be located on a first length horizontal side of the horizontal adjustment member and the horizontal adjustment recess may be located on a second length horizontal side of the horizontal adjustment member, the first length horizontal side being different from the second length horizontal side.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the description above.

What is claimed is:

1. A L-shaped reticle alignment tool, comprising:

a vertical adjustment leg;

a horizontal adjustment leg;

a sliding hammer;

a vertical adjustment recess located on said vertical adjustment leg;

a horizontal adjustment recess located on said horizontal adjustment leg; and a sliding hammer recess located on said horizontal adjustment leg;

said sliding hammer being located within said sliding hammer recess;

said sliding hammer being configured to move bi-directionally, within said sliding hammer recess, to impart a force onto a side of said sliding hammer recess.

2. The L-shaped reticle alignment tool, as claimed in claim 1, wherein said vertical adjustment recess has a center vertical adjustment recess line and said horizontal adjustment recess has a center horizontal adjustment recess line, said center vertical adjustment recess line being parallel to said center horizontal adjustment recess line.

3. The L-shaped reticle alignment tool, as claimed in claim 1, wherein said sliding hammer moves in a direction parallel to said horizontal adjustment leg.

4. The L-shaped reticle alignment tool, as claimed in claim 1, wherein said sliding hammer recess is located on a first length horizontal side of said horizontal adjustment leg;

said sliding hammer being located on said first length horizontal side of said horizontal adjustment leg;

said horizontal adjustment recess being located on a second length horizontal side of said horizontal adjustment leg;

said first length horizontal side being different from said second length horizontal side.

5. The L-shaped reticle alignment tool, as claimed in claim 1, wherein said sliding hammer recess is located on a first length horizontal side of said horizontal adjustment leg;

said sliding hammer being located on a said first length horizontal side of said horizontal adjustment leg;

said horizontal adjustment recess being located on said first length horizontal side of said horizontal adjustment leg.

6. A L-shaped vertical reticle alignment tool, comprising:

a vertical adjustment leg;

a handle leg;

a sliding hammer;

a vertical adjustment recess located on said vertical adjustment leg; and a sliding hammer recess located on said handle leg;

said sliding hammer being located within said sliding hammer recess;

said sliding hammer being configured to move bi-directionally, within said sliding hammer recess, to impart a force onto a side of said sliding hammer recess.

7. The L-shaped reticle alignment tool, as claimed in claim 6, wherein said sliding hammer moves in a direction parallel to said handle leg.

8. A reticle alignment tool, comprising:

a horizontal adjustment member;

a sliding hammer;

a horizontal adjustment recess located on said horizontal adjustment member; and a sliding hammer recess located on said horizontal adjustment member;

said sliding hammer being located within said sliding hammer recess;

said sliding hammer being configured to move bi-directionally, within said sliding hammer recess, to impart a force onto a side of said sliding hammer recess.

9. The alignment tool, as claimed in claim 8, wherein said sliding hammer recess is located on a first length horizontal side of said horizontal adjustment leg;

said sliding hammer is being located on said first length horizontal side of said horizontal adjustment leg;

said horizontal adjustment recess being located on said first length horizontal side of said horizontal adjustment leg.

10. The reticle alignment tool, as claimed in claim 8, wherein said sliding hammer recess is located on a first length horizontal side of said horizontal adjustment leg;

said sliding hammer being located on said first length horizontal side of said horizontal adjustment leg;

said horizontal adjustment recess being located on a second length horizontal side of said horizontal adjustment leg;

said first length horizontal side being different from said second length horizontal side.

* * * * *